US005621423A

United States Patent [19]

Sureau

[11] Patent Number: 5,621,423

[45] Date of Patent: Apr. 15, 1997

[54] ELECTROMAGNETIC ENERGY SHIELD

[75] Inventor: Jean-Claude Sureau, Boston, Mass.

[73] Assignee: Radant Systems, Inc., Stow, Mass.

[21] Appl. No.: 527,029

[22] Filed: Aug. 29, 1983

[51] Int. Cl.[6] ..... H01Q 15/02; H01Q 15/24

[52] U.S. Cl. ..... 343/909; 343/872

[58] Field of Search ..... 343/754, 756, 343/909, 872

[56] References Cited

U.S. PATENT DOCUMENTS

| | | | |
|---|---|---|---|
| 3,708,796 | 1/1973 | Gilbert | 343/909 |
| 3,961,333 | 6/1976 | Purinton | 343/872 |
| 4,212,014 | 7/1980 | Chekroun | 343/754 |

*Primary Examiner*—Theodore M. Blum
*Attorney, Agent, or Firm*—Ernest V. Linek, Esq.

[57] ABSTRACT

A radome for providing a relatively wide-band operation which in a preferred embodiment uses at least a pair of panel means mounted adjacent each other, each having a plurality of discontinuous conductive elements applied to a selected surface thereof in an array of parallel paths. The discontinuous elements in each path of the array are interconnected by diode means which can be biased in a non-conductive direction during a first transmit mode and in a conductive direction during a second non-transmit mode. The panels are separated by a distance which is substantially equal to one quarter wave length ($\lambda_s/4$) at a selected frequency within the wide pass-band of electromagnetic energy which is to be transmitted. The overall structure essentially operates as a wide band, low-pass transmission device transmitting energy at frequencies within the selected pass-band during the transmit mode and rejecting transmission at all frequencies within at least this same selected pass-band during the non-transmit mode.

12 Claims, 1 Drawing Sheet

ELECTROMAGNETIC ENERGY SHIELD

INTRODUCTION

This invention relates generally to structures for selectively transmitting electromagnetic energy and, more particularly, to structures arranged so that at selected times the transmission of electromagnetic energy therethrough is permitted in a selected frequency range and at other selected times the transmission therethrough of electromagnetic energy in such selected frequency ranges is substantially reduced. Such structures can be used, for example, as radome structures for shielding microwave antennas and auxilliary equipment from externally incident energy.

BACKGROUND OF THE INVENTION

Radome structures are conventionally used to protect microwave antennas and associated equipment, for example, from the physical environment. It is also often desirable to shield such equipment from externally incident electromagnetic energy which can adversely affect the electrical operating characteristics thereof. Ideally, such a shield structure should be arranged, during operation of the antenna equipment, to be substantially transparent to the energy in the selected frequency range handled by the antenna but should reject or suppress all frequencies outside such selected frequency range.

Further, when the antenna equipment is not operating, such a shield structure should effectively reject or substantially suppress the transmission of electromagnetic energy at all frequencies. The structure acts as an electromagnetic "shutter" which is effectively "open" only to the desired operating frequency band during operation and is "closed" to all frequencies when not in operation.

One particular such radome shutter structure is disclosed in my copending U.S. patent application, Ser. No. 415,260, filed Sep. 7, 1982, and entitled "Electromagnetic Energy Shield". In such structure in the "open" state the radome structure provides a selective band-pass characteristic which permits the transmission therethrough of electromagnetic energy having frequencies within a selected pass-band, usually a relatively narrow pass-band, while energies having frequencies outside the pass-band are effectively rejected. In the "closed" state the structure is arranged to substantially reduce the transmission of energy both within the selected band as well as outside the pass-band.

In some instances, however, it is desirable to provide a relatively wide-band structure rather than the relatively narrow band operation as in the structure described in my previously filed application. For example, such a radome structure may be used with wide-band antennas and may be utilized with antennas which are providing only passive "listening" operations in which, in the non-operating state, it is desirable that the structure be "closed" to all frequencies when the passive antennas are shut off in order to avoid detection.

BRIEF SUMMARY OF THE INVENTION

The invention provides an electromagnetic energy shield structure, e.g., a radome which is relatively easy to fabricate and which provides a relatively wide-band operation. In a particular embodiment, for example, the structure may act effectively as a wide, low pass transmission device.

In accordance with a particular embodiment thereof, the structure utilizes at least a pair of panel means which are positioned within a suitable housing. Each of the panel means includes a substrate and a plurality of discontinuous conductive elements applied to a selected surface thereof in an array of parallel paths. The discontinuous elements in each path of the array are interconnected by diode means which can be biased in a non-conductive direction during a first operating mode and in a conductive direction during a second operating mode. In a preferred embodiment the panel means are mounted adjacent each other so that the surfaces containing the array of discontinuous conductive elements and diodes are substantially parallel and so that the panels are separated by a distance which is substantially equal to one quarter wave length ($\lambda_s/4$) at a selected frequency within the wide pass-band of electromagnetic energy which is to be transmitted during the transmit or operating mode, i.e., when the diodes are biased in a non-conductive direction.

Such a structure essentially operates as a wide band, low-pass transmission device which effectively transmits electromagnetic energy at frequencies within the selected pass-band during the non-conductive mode and which effectively rejects or substantially suppresses transmission at all frequencies within at least this same selected pass-band during the conductive mode.

DESCRIPTION OF THE INVENTION

The invention can be described in more detail with the help of the accompanying drawings wherein.

Figure 1:
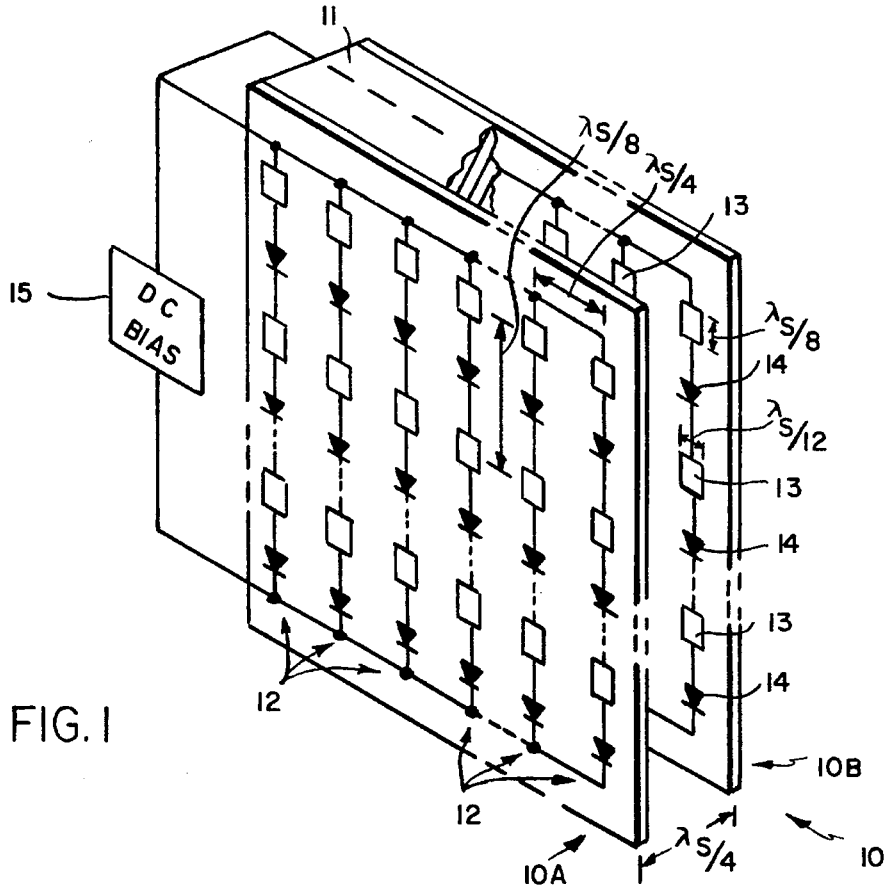
FIG. 1 shows a pair of panels fabricated in accordance with a preferred embodiment of the invention.

As can be seen in a preferred embodiment of a basic structure in accordance with the invention, as shown in FIG. 1, a pair of panels 10, as formed by substrates 10A and 10B, are separated by a suitable low density foam or non-metallic honeycomb structure 11, Each panel substrate carries a plurality of parallel paths 12, each of which comprises a plurality of separate conductive elements 13 interconnected by diodes 14 as shown. The diodes in each path are, in effect, series-connected and are all commonly connected to a DC bias power supply 15. The power supply is arranged so that it can be rapidly switched from one polarity to the other in a conventional manner so as to reverse bias or to forward bias the diode as desired.

During an operating mode, i.e., when it is desired that electromagnetic energy, which is incident upon the panels 10A and 10B and which lies in a selected and relatively wide frequency band, be transmitted through the panels, all of the diodes 14 on both panels are reverse biased so that all diodes are in a non-conductive state. In such case the conductive elements 13 essentially exhibit capacitive behavior and effectively represent a plurality of parallel capacitive elements.

Figure 2:
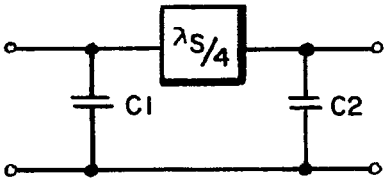
FIG. 2 shows an equivalent circuit representing the panels of FIG. 1 in a non-conductive mode of operation.

Each panel can then be considered essentially as a capacitive reactive sheet of low susceptance, such as is depicted by the equivalent transmission line circuit shown in FIG. 2. In such figure the capacitance C1 represents the capacitance of panel 10A and the capacitance C2 represents that of panel 10B, the distance between the capacitances along the transmission line being substantially equal to (generally slightly less than) a quarter wave length ($\lambda_s/4$) at a selected upper frequency $f_s$ of a pass-band. Such distance is determined by the distance between the panels as shown in the structure of FIG. 1.

Figure 3:
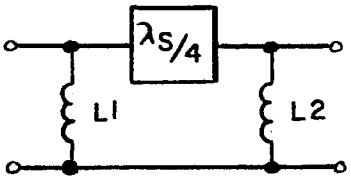
FIG. 3 shows an equivalent circuit representing the panels of FIG. 1 in a conductive mode of operation.

When the diodes are forward biased each of the panels then effectively has a plurality of parallel continuously conductive paths on the surfaces thereof and, in the equivalent circuits, the panels appear effectively as inductances L1 and L2, as shown in FIG. 3. Transmission through the panels at all frequencies less than $f_s$ and also somewhat greater than $f_s$ then becomes extremely low. It is further found that separation of the panels by the nearby quarter wave length at the selected frequency enhances the supression of frequencies over the selected pass-band.

In the preferred embodiment described, the width of each of the conductive elements 13 is preferably selected to be $\lambda_s/12$ and the length as $\lambda_s/8$, as shown. Each of the elements along a particular path is separated from adjacent elements in the same path by $\lambda_s/4$ (for clarity such dimension is not shown in relative proportion to the other dimensions in the figure) and each of the parallel paths is separated by no more than $\lambda_s/4$ from its adjacent path or paths, as shown.

Figure 4:
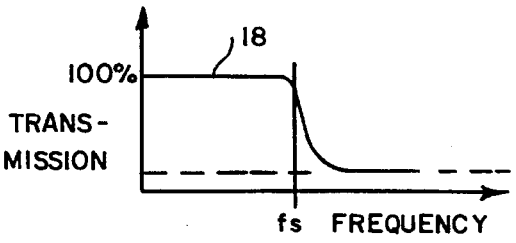
FIG. 4 shows a graph which depicts in a qualitative fashion the low pass operation of the embodiment of FIG. 1.

When the diodes are reverse-biased, good transmission at the selected frequency $f_s$ and low frequencies is obtained, which good transmission tends to hold for a relatively limited range of frequencies above $f_s$ and for a much broader range of frequencies below $f_s$, the overall broad pass-band being as generally shown qualitatively by the curve 18 in the graph of FIG. 4.

When the diodes are forward-biased, a relatively low transmission is obtained for all frequencies below $f_s$ as well as for some frequencies above. As mentioned above, the separation between panels which is set up to optimize the transmission at a selected frequency within the wide pass-band also tends to enhance the supression of such transmission over the entire pass-band.

Supression of the transmission of frequencies within the pass-band in the forward-biased state can be further enhanced by utilizing more than one pair of such panels and a number of pairs thereof may be utilized for such purpose, each additional pair further suppressing such transmission as desired, without adversely affecting the desired transmission within the pass-band during the operating mode.

Figure 5:
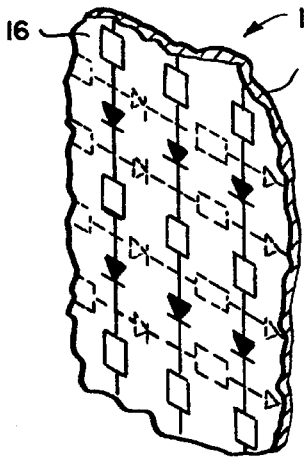
FIG. 5 shows an alternative embodiment of the panels of FIG. 1 in accordance with the invention.

The embodiment of FIG. 1 is effectively designed for use with electromagnetic energy which has a polarization substantially parallel to the paths 12 of discontinuous elements 13 shown in FIG. 1. If it is desired that the performance characteristic of the system be effectively independent of polarization, each panel can be arranged to contain orthogonal grids or paths of discontinuous element/diode arrays as shown in FIG. 5. The orthogonal arrays on each panel can be suitably positioned, for example, on opposite, i.e., front and rear, surfaces of each substrate. The front arrays are shown by solid lines on surface 16 of substrate 10A, for example, and the orthogonal rear arrays by dashed lines on surface 17 in FIG. 5.

Moreover, the system can be arranged to provide optimum operation for several angles of incidence of electromagnetic energy which may impinge thereon by using several pairs of panels, as in multi-layer sandwich radome systems. Indeed the system has numerous parameters available to a designer (conductive element dimensions and separation, panel separation, etc.) which can be varied in accordance with whatever is desired for a particular application.

Further as mentioned in my above-referenced U.S. patent application, the panels can be shaped in such a manner as to conform to the shape of a radome structure and mounted adjacent thereto or can be integrally formed with the radome structure itself. Further the panels can be shaped independently of the shape of the radome structure and formed separately therefrom so as to be mounted in any appropriate manner within the radome structure.

Although the embodiments discussed above are preferred embodiments of structures in accordance with the invention, modifications thereto may occur to those in the art within the spirit and scope of the invention. Accordingly, the invention is not to be construed as limited to the specific embodiments disclosed except as defined by the appended claims.

What is claimed is:

1. A structure for selectively transmitting electromagnetic energy, said structure comprising:

at least a pair of shutter members mounted in said structure, each of said members including a plurality of parallel paths, each path comprising a plurality of separate two-dimensional, planar conductive elements;

diode means interconnecting adjacent elements in each said path;

means for biasing said diode means in a non-conductive direction during a first operating mode so that said shutter members have substantially capacitive characteristics over a selected frequency range so as to permit the substantial transmission through said members of electromagnetic energy incident thereon within said selected frequency range and to prevent transmission outside said selected frequency range and for biasing said diode means in a conductive direction during a second operating mode so that said shutter members have substantially inductive characteristics so as to substantially prevent the transmission of electromagnetic energy through said members within and outside said frequency range.

2. A structure in accordance with claim 1 wherein the dimensions and spacing of said conductive elements and the spacing of said shutter members relative to each other are selected to determine said selected frequency range.

3. A structure in accordance with claim 1 wherein the spacing between said shutter members is selected to be approximately $\lambda_s/4$ wherein $\lambda_s$ is the wavelength of a selected frequency $f_s$ within said selected frequency range at which substantially maximum electromagnetic energy is transmitted in said first operating mode.

4. A structure in accordance with claim 3 wherein said conductive elements are spaced apart on each path thereof by approximately $\lambda_s/4$ or less and the conductive elements on any path are spaced from the conductive elements on a path adjacent thereto by approximately $\lambda_s/4$ or less.

5. A structure in accordance with claim 4 wherein the longer dimension of the plane of each of said conductive elements is approximately $\lambda_s/4$ and the shorter dimension of the plane thereof is approximately $\lambda_s/12$.

6. A structure in accordance with claim 5 wherein the plane of each said conductive element is rectangular.

7. A structure in accordance with claim 3 wherein said dimensions and said spacings are selected so that the range of frequencies above $f_s$ which are transmitted is substantially less than the range of frequencies which are transmitted below $f_s$.

8. A structure in accordance with claim 2 wherein said dimensions and said spacings are selected so that said selected frequency range is substantially one octave or more.

9. A structure in accordance with claim 1 wherein each of said shutter members comprises a substrate, said plurality of paths of conductive elements and diodes being formed on a first planar surface of said substrate.

10. A structure in accordance with claim 9 wherein each of said shutter means further includes a further plurality of paths of conductive elements and diodes formed on a second opposite planar surface of said substrate, the plurality of paths on said second planar surface being orthogonal to the plurality of paths on said first planar surface.

11. A structure in accordance with claim 1 wherein said structure comprises a pair of said shutter members.

12. A structure in accordance with claim 1 wherein said structure comprises a plurality of pairs of said shutter members.

* * * * *